United States Patent [19]

Landa et al.

[11] Patent Number: 4,985,732

[45] Date of Patent: Jan. 15, 1991

[54] ELECTROSTATIC SEPARATOR

[75] Inventors: Benzion Landa, Edmonton, Canada; Shabtai Ezuz, Moshav Beit Hannan, Israel; Jakob Karin, Ramat Gan, Israel; Paul Fenster, Petach Tikva, Israel

[73] Assignee: Spectrum Sciences B.V., Rotterdam, Netherlands

[21] Appl. No.: 320,614

[22] Filed: Mar. 8, 1989

[51] Int. Cl.[5] ..... G03G 15/10

[52] U.S. Cl. ..... 355/256; 118/662; 355/268; 430/117

[58] Field of Search ..... 355/256, 268, 251, 261, 355/245; 118/662, 645, 695; 430/117, 118, 119

[56] References Cited

U.S. PATENT DOCUMENTS

| | | | |
|---|---|---|---|
| 3,790,466 | 5/1969 | Akiyama . | |
| 3,863,603 | 2/1975 | Buckley et al. . | |
| 3,959,574 | 5/1976 | Seanor et al. . | |
| 4,161,360 | 7/1979 | Smith | 355/256 |
| 4,235,195 | 11/1980 | Yoshino | 355/256 |
| 4,278,343 | 7/1981 | Kurokawa | 355/256 |
| 4,286,039 | 8/1981 | Landa et al. . | |
| 4,373,800 | 2/1983 | Kamiyama et al. | 355/256 |
| 4,482,241 | 11/1984 | Moraw et al. | 430/117 |
| 4,504,138 | 3/1985 | Kuehnle et al. . | |
| 4,686,936 | 8/1987 | Chow . | |
| 4,737,268 | 4/1988 | Giddings . | |
| 4,768,060 | 8/1988 | Landa et al. . | |
| 4,794,651 | 12/1988 | Landa et al. . | |
| 4,799,452 | 1/1989 | Day . | |

FOREIGN PATENT DOCUMENTS

| | | |
|---|---|---|
| 60-69671 | 4/1985 | Japan . |
| 58-33274 | 3/1983 | Japan . |

*Primary Examiner*—A. T. Grimley
*Assistant Examiner*—Thu A. Dang
*Attorney, Agent, or Firm*—Sandler, Greenblum & Bernstein

[57] ABSTRACT

Apparatus including a drum having a drum surface, apparatus for supplying a particle dispersion comprising particles to the drum surface, electrostatic apparatus for causing at least some of the particles to adhere to the drum surface and resilient blade apparatus downstream of the electrostatic apparatus for operative engagement with the drum surface for retaining a layer of particle rich material on the drum surface.

27 Claims, 1 Drawing Sheet

ELECTROSTATIC SEPARATOR

FIELD OF THE INVENTION

The present invention relates to electrostatic imaging generally and more particularly to liquid toner electrostatic imaging.

BACKGROUND OF THE INVENTION

Separation of toner particles from carrier liquid is important in various applications of electrophotography. Various types of separation apparatus are known in the patent literature. For example, there is described in U.S. Pat. No. 4,737,268 apparatus for electrostatically separating particles in a liquid stream. The technique of U.S. Pat. No. 4,737,268 is essentially a plating operation and thus requires periodic deplating in order to operate.

There is described in U.S. Pat. No. 4,504,138 a method and apparatus for developing electrostatic latent images wherein a thin highly viscous layer of concentrated toner particles is defined on a roller, portions of the layer being transferred to an image bearing surface by electrostatic means.

SUMMARY OF THE INVENTION

The present invention seeks to provide improved apparatus for separating toner particles from a carrier liquid and for creating a layer of concentrated toner particles on a drum.

There is thus provided in accordance with a preferred embodiment of the present invention apparatus including a drum having a drum surface, apparatus for supplying a particle dispersion comprising particles to the drum surface, electrostatic apparatus for causing the particles to adhere to the drum surface and resilient blade apparatus downstream of the electrostatic apparatus for operative engagement with the drum surface for retaining a layer of particle rich material on the drum surface.

In accordance with a preferred embodiment of the invention, the apparatus includes layer removal apparatus for removing the layer of carrier liquid relatively rich in toner particles from the drum to a receiving apparatus.

In accordance with a preferred embodiment of the invention, the apparatus for supplying comprises a bath through which the drum surface travels. In accordance with a preferred embodiment of the invention, the bath includes an outlet for relatively particle free carrier liquid.

In accordance with a preferred embodiment the blade is maintained at an electrical potential different from the electrical potential of said drum surface.

Further in accordance with a preferred embodiment of the invention, the blade apparatus comprises a blade formed of a relatively resilient material, such as polyurethane.

According to one embodiment of the invention, the resilient blade apparatus may be replaced by a squeegee roller maintained at a potential of the same sign as the charge on the toner particles.

In accordance with an embodiment of the invention, multiple passes of the drum surface may be provided in order to build up a highly concentrated uniform layer of toner rich material.

In accordance with a preferred embodiment of the invention there is provided a method including the steps of supplying a particle dispersion comprising particles to a drum surface, causing at least a portion of the particles to adhere to the drum surface and causing a resilient blade apparatus to operatively engage the drum surface for retaining a layer of pigmented particle rich material thereon.

There is also provided in accordance with a preferred embodiment of the invention, a method for separating toner particles from a carrier liquid including the steps of supplying a carrier liquid-toner particle mixture to a generally cylindrical surface, further concentrating the layer and removing therefrom a substantial portion of the carrier liquid and repeating the supplying and concentrating steps multiple times in order to build up a concentrated uniform layer of toner rich material.

In accordance with a preferred embodiment of the invention, the step of supplying comprises the step of causing the cylindrical surface to pass through a bath containing charged toner particles.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1:
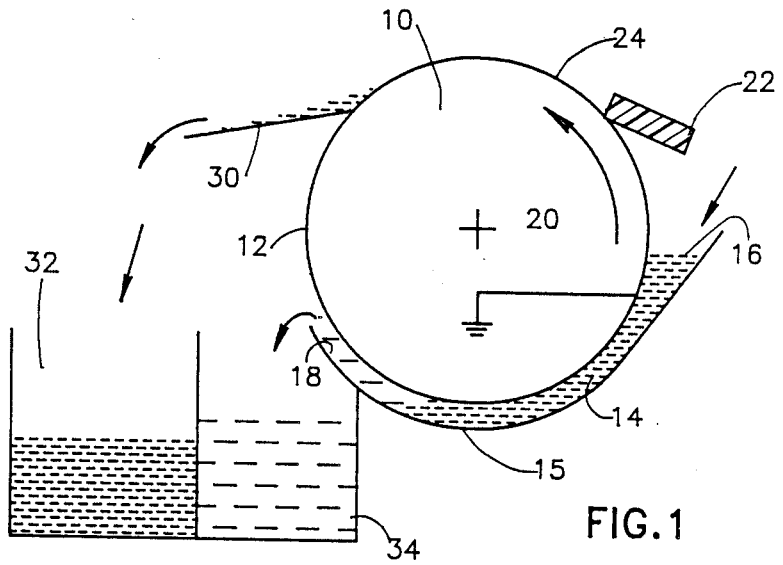
FIG. 1 is a schematic illustration of apparatus constructed and operative in accordance with a preferred embodiment of the present invention.

Reference is now made to FIG. 1, which illustrates apparatus constructed and operative in accordance with a preferred embodiment of the invention including a drum 10, typically formed of metal and having a preferably cylindrical drum surface 12, also typically formed of metal. Preferably drum surface 12 is grounded.

There is provided a liquid toner bath 14, typically defined by a negatively biased electrode 15, and which defines an inlet 16 for receipt of liquid toner and an outlet 18, typically disposed lower than inlet 16, for removal of carrier liquid which is relatively free of toner particles. Toner bath 14 is arranged preferably such that approximately one half of the drum height is immersed in the bath at the side of inlet 16 and less than one half of the drum height is immersed in the bath at the side of outlet 18. The toner located in bath 14 typically comprises negatively charged particles. If alternatively it is desired to employ positively charged toner particles, the electrode is accordingly positively biased.

In the illustrated embodiment, the drum rotates in the direction of arrow 20 from the side adjacent outlet 18 through the bath 14 to the side adjacent inlet 16. Downstream of bath 14 there is provided a first blade 22, typically arranged at the upper, upward rotating quadrant of the drum surface 12, for operatively engaging the drum surface 12. According to a preferred embodiment of the invention, the first blade is operative to define on the drum surface a layer 24 of relatively viscous concentrated liquid toner.

According to a preferred embodiment of the present invention, the first blade is typically formed of resilient polyurethane with a Shore A hardness of typically 20 to 60 and of thickness 2 mm and is arranged to apply a total pressure of about 100 grams along a length of about 20 cm.

Use of a resilient blade provides a generally uniform pressure to the layer of toner material notwithstanding variations in the relative positioning of the drum surface thereto.

According to a possible alternative embodiment of the invention the drum surface 12 is formed of relatively resilient material and the first blade 22 may be formed of relatively less resilient material.

According to a preferred embodiment of the invention, the first blade may be maintained at a potential which is the same in sign as that of the charge on the toner particles, to compact the image and aid in liquid removal. For this embodiment the blade may be made of conductive resilient polymeric materials as described in either or both of U.S. Pat. Nos. 3,959,574 and 3,863,603 which are incorporated herein by reference. In order to avoid the possibility of arcing, as for example when there are no toner particles on the drum, conventional electrical current limitation apparatus may be added to the potential power supply.

In accordance with an embodiment of the invention, the apparatus of the present invention may also include scraper blade apparatus 30, which typically operatively engages the drum surface 12 at the upper, downward rotating quadrant of the drum surface. Scraper blade apparatus 30 is operative to remove layer 24 and to direct the relatively viscous concentrated liquid toner of which layer 24 is composed to a concentrated dispersion tank 32. A tank 34 may be also provided for receipt of relatively clear carrier liquid from outlet 18. It is appreciated that scraper blade apparatus 30 may alternatively be eliminated.

According to a preferred embodiment of the invention an inlet toner particle concentration of about 1.5% may be used with a bath electrode potential of approximately −800 to −1000 volts when the electrode is separated from the drum 10 by a distance of about 500 microns. For a typical drum diameter of 120 mm, a drum surface linear velocity of about 10 cm/sec may be employed. It is appreciated that when the scraper blade apparatus 30 is not used or is disengaged, the drum and the layer built up thereon may be rotated multiple times through the bath 14 and past the first blade to provide enhanced layer uniformity, thickness and concentration. Three to four such rotations are preferred and provide a layer of typical thickness of about 5 microns. Should it be desired to remove the built up layer, the scraper blade apparatus 30 may be re-engaged.

Figure 2:
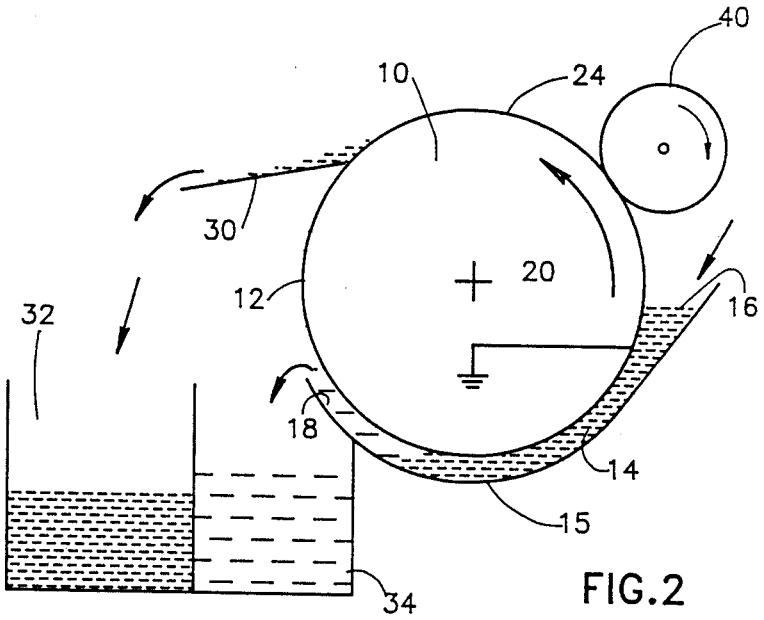
FIG. 2 is a schematic illustration of apparatus constructed and operative in accordance with a preferred embodiment of the present invention.

Reference is now made to FIG. 2, which illustrates apparatus which is substantially similar to the apparatus of FIG. 1, with the exception that the first blade 22 is replaced by a charged squeegee roller 40. Squeegee roller 40 is typically formed of resilient polymeric material such as that described in either or both U.S. Pat. Nos. 3,959,574 and 3,863,603, having a hardness of typically 20 to 60 shore A and applies a pressure of to the layer 24 sufficient to form a nip, typically 0.5 to 1 cm in length along the direction of rotation. Where negatively charged toner particles are employed it is maintained at a typical voltage of 750 volts. In order to avoid the possibility of arcing, as for example when there are no toner particles on the drum, conventional electrical current limitation apparatus may be added to the potential power supply.

The present invention is especially useful when practiced with liquid toner materials of the type disclosed in U.S. Pat. No. 4,794,651 which is incorporated herein by reference. It is also useful when practiced on a variety of other liquid toner types.

It will be appreciated by persons skilled in the art that the present invention is not limited by what has been particularly shown and described hereinabove. Rather the scope of the present invention is defined only by the claims which follow:

We claim:

1. Electrostatic separator apparatus for separation of particles from a liquid comprising:

a drum having a drum surface;

means for supplying a particle dispersion comprising particles dispersed in a liquid to the drum surface;

electrostatic means for causing at least some of the particles to adhere to the drum surface without forming an image thereon;

resilient blade means, downstream of the electrostatic means for operative engagement with the drum surface for retaining a layer of particle rich material on the drum surface; and layer removal means for layerwise removing substantially all of said layer from the drum surface.

2. Apparatus according to claim 1 wherein said blade is maintained at an electrical potential different from the electrical potential of said drum surface.

3. Apparatus according to claim 2 wherein said particles are charged and said blade means is maintained at an electrical potential which is operative to repel said particles toward said drum surface.

4. Apparatus for the separation of particles from a liquid comprising:

a drum having a drum surface;

means for supplying a particle dispersion comprising particles dispersed in a liquid to the drum surface;

electrostatic means for causing at least some of the particles to adhere to the drum surface without forming an image thereon;

retaining means downstream of the electrostatic means for operative engagement with the drum surface for retaining a layer of particle rich material on the drum surface, said means maintained at a potential different from that of the drum surface; and layer removal means for layerwise removing of substantially all of said layer from the drum surface.

5. Apparatus according to claim 4 and wherein said retaining means comprises a blade.

6. Apparatus according to claim 4 and wherein said retaining means comprises a squeegee roller.

7. Apparatus according to claim 5 and wherein said particles are charged and said retaining means is operative to repel said particles toward said drum surface.

8. Apparatus according to claim 6 and wherein said particles are charged and said retaining means is operative to repel said particles toward said drum surface.

9. Apparatus according to claim 1 and wherein said means for supplying comprises a bath through which said drum surface travels.

10. Apparatus according to claim 4 and wherein said means for supplying comprises a bath through which said drum surface travels.

11. Apparatus for separation of toner particles from a carrier liquid comprising a surface; means for repeatedly supplying a layer of material relatively rich in toner particles and containing liquid carrier liquid to the surface and for subsequently concentrating said layer and removing therefrom a substantial portion of the carrier liquid.

12. Apparatus according to claim 11 and wherein said toner material is charged and said means for repeatedly supplying and concentrating includes concentrating means maintained at a potential of the same sign as the charge on the toner particles.

13. Apparatus according to claim 12 and wherein said means for repeatedly supplying and concentrating includes concentrating means comprising a blade.

14. Apparatus according to claim 12 and wherein said means for repeatedly supplying and concentrating includes concentrating means comprising a blade.

15. Apparatus according to claim 11 and wherein said means for repeatedly supplying and concentrating includes concentrating means comprising a squeegee roller.

16. Apparatus according to claim 12 and wherein said means for repeatedly supplying and concentrating includes concentrating means comprising a squeegee roller.

17. Apparatus for the separation of particles from a liquid comprising:

a drum having a resilient drum surface;

means for supplying a particle dispersion comprising particles to the drum surface;

means for causing at least some of the particles to adhere to the drum surface; and retaining means for operative engagement with the drum surface for retaining a layer of particle rich material on the drum surface without forming an image thereon.

18. A method for separation of particles from a liquid comprising the steps of:

supplying a particle dispersion comprising particles in a carrier liquid to a surface;

causing at least some of the particles in said dispersion to adhere to said surface without forming an image thereon;

contacting said surface with a resilient blade for retaining a layer of particle rich material on said surface; and layerwise removing of substantially all of said layer from the surface.

19. A method for separation of particles from a liquid comprising the steps of:

supplying a layer of material having a thickness relatively rich in toner and containing carrier liquid to a surface;

further concentrating said layer and removing therefrom a substantial portion of the carrier liquid; and repeating the steps of supplying and further concentrating to increase the thickness of said layer.

20. A method for separation of particles from a liquid comprising the steps of:

supplying a layer of material relatively rich in toner and containing carrier liquid to a surface;

supplying a particle dispersion in a liquid to the surface;

causing at least some of the particles to adhere to the surface without forming an image thereon;

causing operative engagement of an electrified member with the surface for retaining a layer of particle rich material on the surface; and layerwise removing of substantially all of said layer from the surface.

21. Apparatus according to claim 11 and also comprising:

layerwise removal means for removing said layer relatively rich in toner particles from the drum surface.

22. Apparatus according to claim 11 wherein said means for supplying supplies said layer in a non-imagewise configuration.

23. Apparatus according to claim 22 and also comprising:

layer removal means for layerwise removing of said layer from the drum surface.

24. A method according to claim 19 and further comprising the step of:

layerwise removal of said layer from the drum surface.

25. A method according to claim 17 and further comprising the step of:

layerwise removal of said layer from the drum surface.

26. Electrostatic separator apparatus for the separation of particles from a liquid comprising:

a drum having a drum surface;

means for supplying a particle dispersion in a liquid to the drum surface;

electrostatic means for causing at least some of the particles to adhere to the drum surface;

resilient blade means, downstream of the means for causing, for operative engagement with the drum surface for retaining a layer of particle rich material on the drum surface; and removal means removing of said layer from the drum surface, wherein an image is not formed in said layer.

27. Apparatus for the separation of particles from a liquid comprising:

a drum having a drum surface;

means for supplying a particle dispersion in a liquid to the drum surface;

means for causing at least some of the particles to adhere to the drum surface without forming an image thereon;

retaining means downstream of the means for causing for operative engagement with the drum surface for retaining a layer of particle rich material on the drum surface, said means maintained at a potential different from that of the drum surface; and removal means removing of said layer from the drum surface, wherein an image is not formed in said layer.

* * * * *